United States Patent [19]

Payton

[11] 4,114,691

[45] Sep. 19, 1978

[54] METHOD FOR CONTROLLING SAND IN THERMAL RECOVERY OF OIL FROM TAR SANDS

[75] Inventor: Joy T. Payton, Houston, Tex.

[73] Assignee: Texaco Inc., New York, N.Y.

[21] Appl. No.: 842,124

[22] Filed: Oct. 14, 1977

[51] Int. Cl.[2] ..... E21B 43/04; E21B 43/08; E21B 43/24

[52] U.S. Cl. ..... 166/276; 166/303

[58] Field of Search ..... 166/276, 278, 57, 51, 166/256, 56, 288, 303, 157, 222, 158; 299/16, 17, 5

[56] References Cited

U.S. PATENT DOCUMENTS

| | | | |
|---|---|---|---|
| 2,349,062 | 5/1944 | Uren | 166/278 |
| 2,745,647 | 5/1956 | Gilmore | 299/5 |
| 2,881,838 | 4/1959 | Morse et al. | 166/303 |
| 2,906,338 | 9/1959 | Shook | 166/278 |
| 2,941,594 | 6/1960 | Ladd et al. | 166/276 |
| 3,379,247 | 4/1968 | Santourian | 166/272 |
| 3,393,736 | 7/1968 | Goodwin | 166/276 |
| 3,858,654 | 1/1975 | Walker | 166/303 X |
| 3,910,351 | 10/1975 | Wu et al. | 166/276 |
| 3,913,671 | 10/1975 | Redford et al. | 166/272 X |
| 3,951,457 | 4/1976 | Redford | 299/5 |

*Primary Examiner*—Stephen J. Novosad
*Attorney, Agent, or Firm*—Carl G. Ries; Thomas H. Whaley; Theron H. Nichols

[57] ABSTRACT

A method is disclosed for producing oil from a subterranean reservoir of tar sands as unconsolidated oil bearing sands. The method comprises basically (1) setting a screen in an open hole, the screen being large enough to pass a majority of the formation sand and small enough to retain a packing material, (2) running a wash pipe through the screen for connecting to a lateral nozzle in a hole in the bottom of the screen for washing out a cavity around the screen, (3) dropping a weight down the wash pipe for breaking off the nozzle for enlarging the screen bottom opening and (4) ejecting a consolidating gravel packing material through the large bottom opening for forming a consolidated gravel pack around the screen for primary production, or (5) agglomerating the gravel pack with chemicals as with resins, plastics, or jelly for secondary recovery production.

11 Claims, 7 Drawing Figures

10
11
12
13
15
16
17
18
19
23
24
21 – HIGH PRESSURE HOT AQUEOUS FLUIDS
22 – HOT FLUIDS, BITUMEN & SAND 10
11
12
13
14
15
16
16a
18
20
TAR SANDS OR VERY LOOSE AND UNCONSOLIDATED FORMATION

METHOD FOR CONTROLLING SAND IN THERMAL RECOVERY OF OIL FROM TAR SANDS

BACKGROUND OF THE INVENTION

Unconsolidated formations where heavy oil or tar is the matrix have hindered the production in oil wells as well as water wells ever since wells have been drilled. Early assumptions were that the sand in the oil had to be lived with. Curtailed producing rates were sometimes used to alleviate sand production.

The problem in tar sands is the undesirable production of sand with the oil or bitumen which is detrimental to most equipment, and particularly to the pumps.

Unconsolidated or poorly consolidated sands or formations are a significant problem to a great degree, particularly in Canada, Texas, Louisiana, and California, on both land and offshore. Sanding is a problem all over the world from the Gulf of Mexico to Venezuela to Nigeria.

Different methods for controlling the migration of sand from unconsolidated formations or tar sands are screens, gravel packs, or agglomerating the formation in place with chemicals. The instant disclosure utilizes a new combination of the above.

U.S. Pat. No. 3,379,247 circulates hot fluids between lower and upper perforations in a tar sand formation, but it also produces sand with the melted bitumen which is detrimental to most mechanical equipment above, as the hydraulic pumps, etc. Assignee's U.S. Pat. No. 3,913,671 discloses circulating an aqueous heating fluid with sodium hydroxide out upper performations and in lower perforations after packing through a sand pack. But this disclosure lacks the steps of running a wash pipe through the screen with a nozzle on lower end thereof and breaking off the nozzle for enlarging the screen opening among other method steps for providing an improved method of sand control and production of bitumen. U.S. Pat. No. 2,905,245 likewise lacks the screen and gravel pack therewith for providing the disclosed improved method for hydrocarbon production in tar sands. U.S. Pat. No. 3,910,351 discloses a pile of granular material around a slotted tube in a cavity, but the granular material fills the cavity completely with no provision for penetration by a screen. U.S. Pat. No. 3,812,913 shows a different method of formation consolidation wherein a bonding agent is applied to the formation.

OBJECTS OF THE INVENTION

Accordingly, a primary object of this invention is to provide an improved process for producing petroleum such as bitumen from a subterranean reservoir of very viscous, semi-solid, immobile hydrocarbon material, such as tar sands, that is economical, practical, and provides uninterrupted and continuous recovery of petroleum from the formation.

Another object of this invention is to provide an improved method for sand control in an open hole type of completion extending into a subterranean reservoir of tar sands, that is economical, practical, and reliable.

A further object of this invention is to provide a method for producing bitumen from tar sands that is easy to operate, comprises simple method steps, is economical to utilize and operate, and is of greater efficiency for the production of hydrocarbons.

Other objects and various advantages of the disclosed process for producing bitumen from tar sands will be apparent from the following detailed description, together with the accompanying drawings, submitted for purposes of illustration only and not intended to define the scope of the invention, reference being made for that purpose to the subjoined claims.

BRIEF DESCRIPTION OF THE DRAWINGS

The drawings diagrammatically illustrate by way of example, not by way of limitation, one embodiment for carrying out the method of producing bitumen from tar sands wherein like reference numerals have been employed to indicate similar parts in the several views in which.

The invention disclosed herein, the scope of which being defined in the appended claims, is not limited in its application to the details of construction and arrangement of parts shown and described for carrying out the disclosed methods, since the invention is capable of other embodiments and systems for carrying out other methods and of being practiced or carried out in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

DESCRIPTION OF THE METHODS

This invention comprises at least one method for producing bitumen from tar sands.

PROCESSES FOR PRODUCING BITUMEN FROM TAR SANDS

Figure 2:
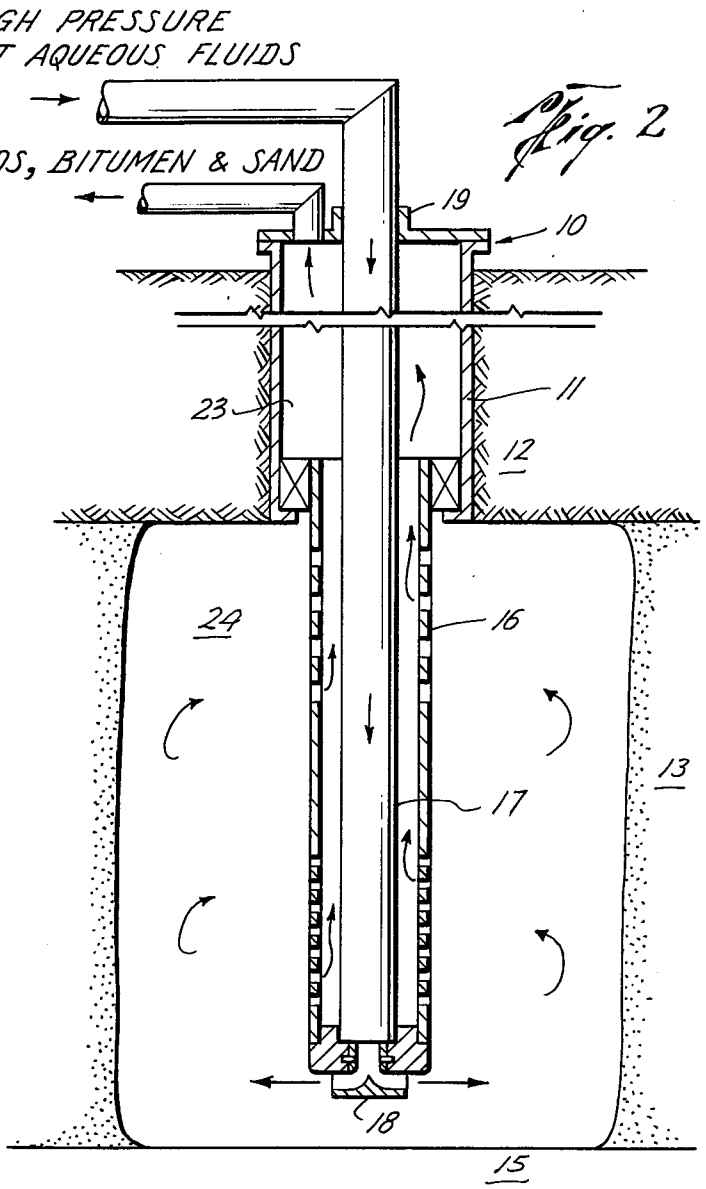
FIG. 2 is the well of FIG. 1 after a wash pipe has been run through the screen for connecting to a nozzle at the screen bottom.
Figure 1:
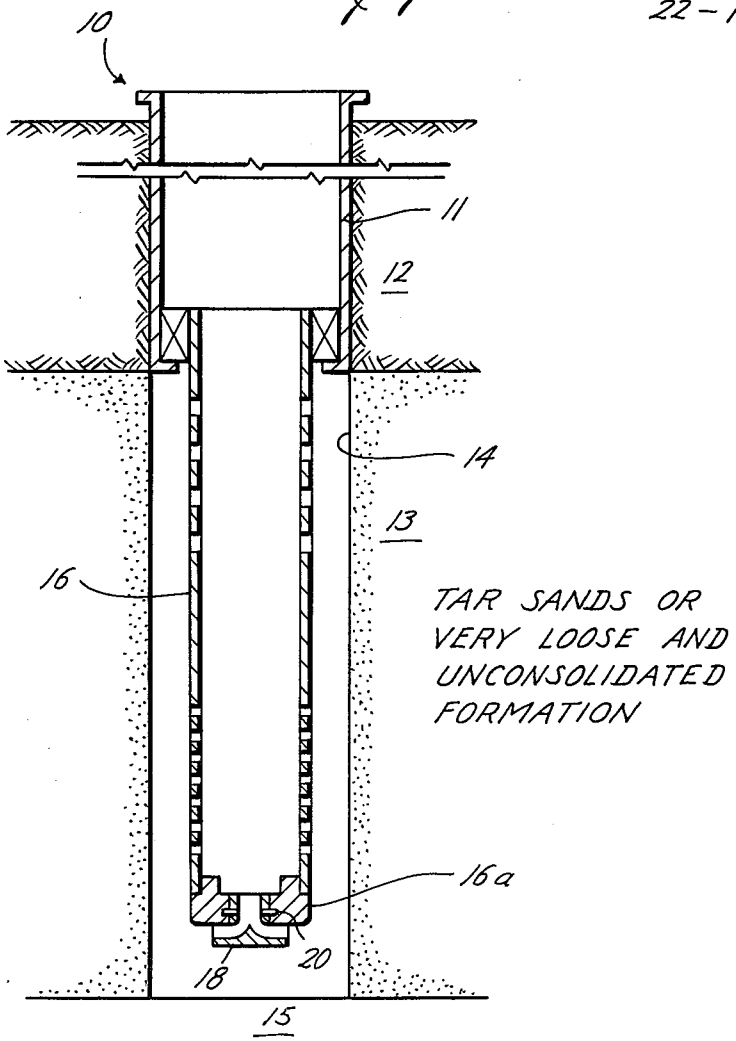
FIG. 1 is a schematic vertical sectional view of a well through a subterranean reservoir of tar sands illustrating one of the first steps of setting a screen in the open hole down through the tar sand formation to the bottom thereof and packing it off against the casing.
Figure 4:
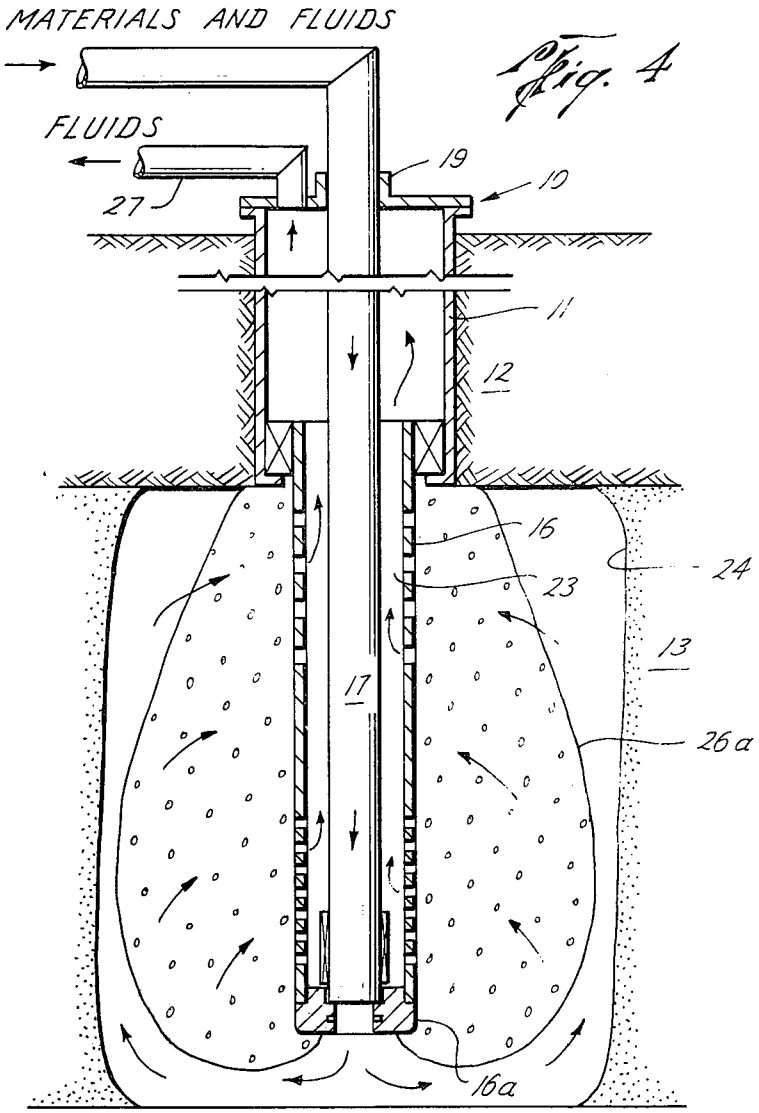
FIG. 4 illustrates injection of the consolidated gravel pack material.
Figure 3A:
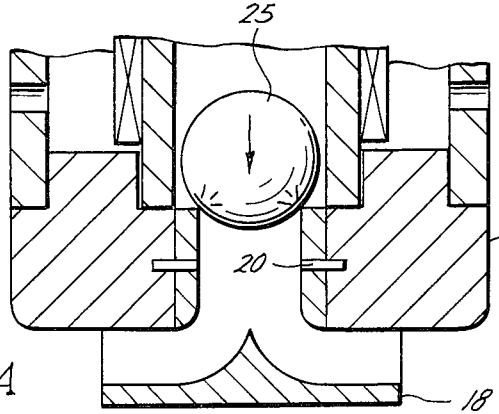
FIG. 3A is the well of FIG. 2 after the cavity has been washed out with a horizontal nozzle and a weight is dropped to break away the nozzle.
Figure 3B:
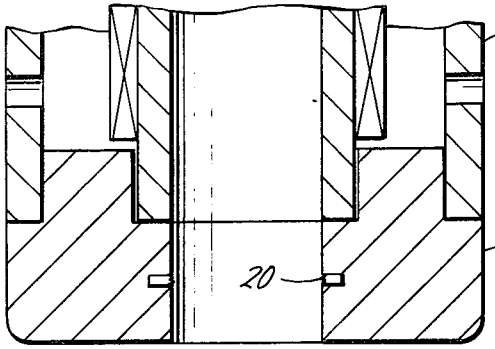
FIG. 3B is the well of FIG. 3A with the nozzle broken out for ejecting a consolidated gravel pack material.
Figure 6:
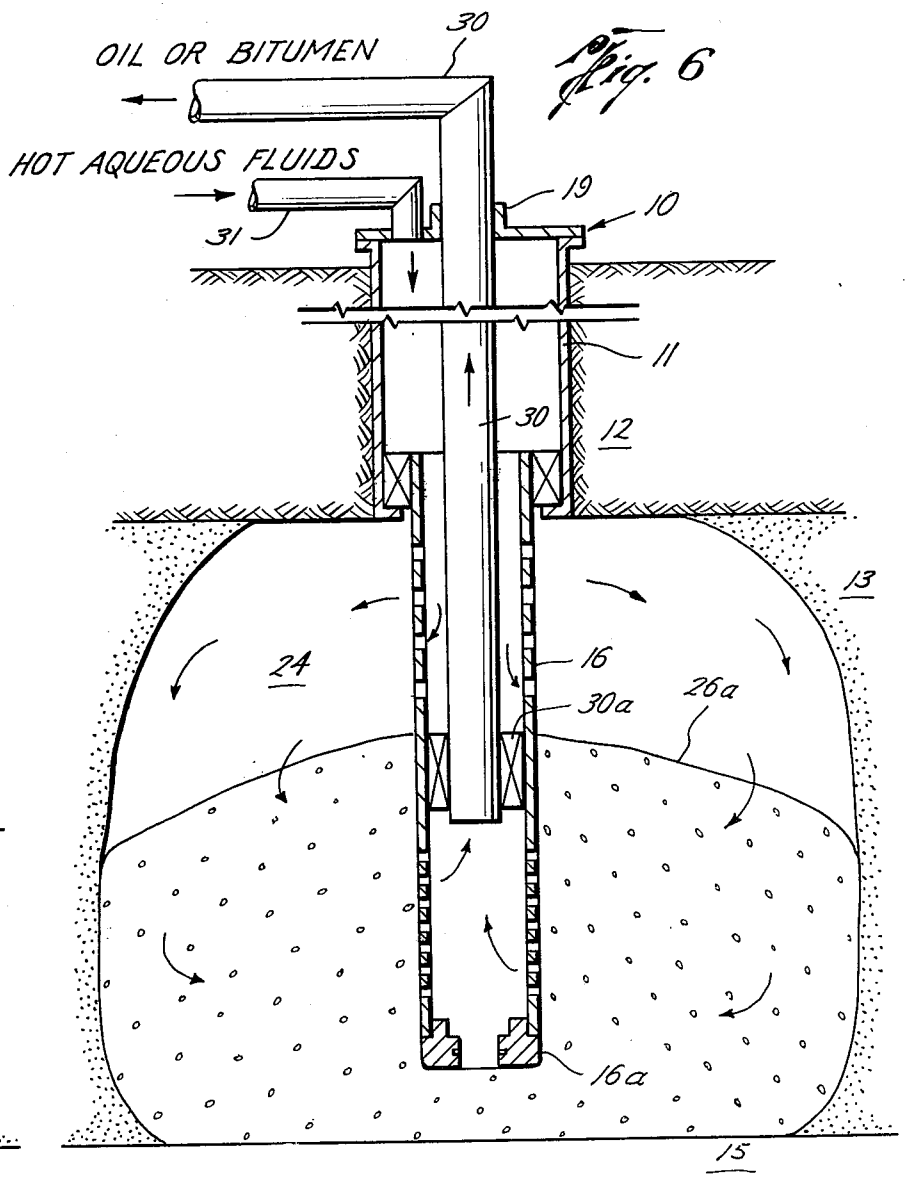
FIG. 6 illustrates a modified gravel pack in the well consolidated around the screen by various consolidating materials as hot aqueous fluids, a jell, or other consolidating chemicals for secondary recovery production.

One aspect of this invention is the production and recovery of viscous petroleum or bitumen from subterranean viscous petroleum-containing formations including tar sand formations by contacting these immobile hydrocarbon deposits in the formation near the production well to facilitate removal thereof from the formation. Thus in greater detail, one method comprises the process steps of:

(1) setting a screen in an open hole, the screen being large enough to pass a majority of the formation sand and small enough to retain a packing material as illustrated in FIG. 1, (2) running a wash pipe through the screen for connecting to a horizontal nozzle in a hole in the bottom of the screen for washing out a cavity around the screen as illustrated in FIG. 2, (3) pumping a weight down the wash pipe for breaking off the nozzle for enlarging the screen bottom opening as illustrated in FIGS. 3A and 3B, and (4) without stopping the flow of fluids into the well, ejecting a consolidating gravel packing material behind the weight through the screen bottom opening for forming a consolidated gravel pack around the screen for primary production as illustrated in FIG. 4, or (5) ejecting hot fluids into the cavity after placement of a packer for melting bitumen from the tar sands for secondary recovery production as illustrated in FIG. 6, or (6) agglomerating the gravel pack with chemicals as by means of resins or with jells for secondary recovery production as illustrated in FIG. 6.

In greater details the above method may be expanded to the following steps:

(1) drilling a well to the top of the petroliferous formation and setting a casing therein (FIG. 1), (2) drilling an open hole section of the well to the bottom of the petroliferous formation (FIG. 1), (3) setting a screen in the open hole and packing it off against the casing, the screen being large enough to pass a majority of the formation sand and small enough to retain a packing material (FIG. 1), (4) forming two oppositely facing horizontal fracturable nozzles on the lower end of the screen (FIG. 1), (5) running a wash pipe down into the screen for connecting to the horizontal double nozzle at the bottom of the screen (FIG. 2), (6) lowering the nozzles, wash pipe, and screen slowly through the depth of the unconsolidated petroliferous formation with the hot aqueous fluids ejecting from the nozzles for forming the cavity of the predetermined size around the screen for melting and producing additional tar and oil from the formation (FIG. 2), (7) without stopping the flow of fluid into the well, pumping a weight down in the wash pipe (FIG. 3A), (8) breaking the nozzles from the lower end of the screen with the pump pressure for enlarging the lower opening in the screen (FIGS. 3A and 3B), (9) without stopping the flow of fluid into the well ejecting a consolidating gravel packing material out the bottom of the wash pipe into the cavity for forming a consolidated gravel pack around the screen so that the packing material will screen-out against the screen while the fluid passes through the screen and back to the surface through the annulus formed between the wash pipe and screen (FIG. 4),

(10) removing the wash pipe and allowing the primary oil to flow through the gravel pack and screen to the surface (FIG. 5), and/or

(11) packing a tube midway down the screen for circulating hot fluids down the tube, out the bottom of the screen, through the cavity and adjacent tar sand formation, through the gravel pack and screen for upward travel through the annulus for recovery at the surface (FIG. 6), and/or Modified step (9) ejecting a conventional jelling gravel packing material from the wash pipe into the cavity for forming a congealed gravel pack around the screen for maintaining the pack in position (FIG. 6), and/or Modified step (9) injecting a consolidating plastic or resin gravel packing material, such as but not limited to, Dow Chemical Company's "Sandlock" described in their booklet "No. SDD-5220 Dowell Sandlock Service", down the annulus between the tube and casing and out the upper screen portion into the cavity for forming a plastic consolidated gravel pack around the lower screen portion for increased sand control in completion of wells extending into the unconsolidated petroliferous formation.

A SYSTEM FOR PRODUCING BITUMEN FROM TAR SANDS

A system is disclosed for producing bitumen from a subterranean reservoir of tar sands, as unconsolidated oil bearing sands from a well having a casing extending down to the tar sand formation.

FIG. 1 discloses a well 10 having a casing 11 extending down through the usual shale formation 12 for example to a tar sand formation 13, which open hole well portion 14 in the formation is drilled down to bedrock 15. A preferred mechanism for washing out or forming a cavity in the well through the unconsolidated oil bearing or tar sand formation comprises the following elements. A liner screen 16, wash pipe 17, FIG. 2, and a hydraulic double nozzle 18, FIG. 1, for example, which has two 180° oppositely positioned openings for ejecting high velocity fluids horizontally or laterally and is rotatable about bearing housing 19, FIG. 2. The nozzle is connected to a cap **16*a* on the bottom of the screen 16 with two or more shear pins 20, FIG. 1, for example. The top of the screen 16 is packed off against the bottom of the casing and extends down through the tar sand or unconsolidated petroliferous formation 13** to the bedrock for example. This screen is large enough to pass a majority of the formation sand and small enough to retain a gravel packing material.

Following packing of the screen in the open hole, a wash pipe 21, FIG. 2, is lowered internally of the screen 16 to connect to the bottom of the screen and accordingly to the double nozzle 18. The high pressure fluid supply wash pipe 17 extends from a suitable source 21 on the surface of high pressure, high velocity, hot aqueous fluids, as hot water, down through the well 10 to the cap **16*a* and the hydraulic double nozzle 18. Nozzle 18 has two 180° oppositely positioned openings for ejecting the high velocity fluids horizontally and is rotatable about bearing housing 17. Thus as the double nozzle ejects hot and high pressure, high velocity fluid in the tar sand formation immediately under the lower end of the casing, the nozzle is slowly rotated and lowered until reaching the lowermost, bedrock position illustrated in FIG. 2. Immediately upon ejection of the hot fluids from the nozzle, a slurry 22 of spent fluids, sand, and bitumen are washed out, pass through the screen and then up the annulus 23 in the well formed between the wash pipe and the well walls to exhaust through a conduit at the surface where the bitumen is recovered therefrom. After a cavity 24, FIG. 2, is formed, the double nozzle 18 is removed by pumping a ball 25 down the wash pipe to shear pins 20, FIG. 3A, to knock the nozzle out of the cap 16*a*** in the bottom of the wash pipe and screen.

A predetermined amount of consolidating graded gravel pack slurry 26, FIG. 4, substantially equivalent to the amount of said and bitumen removed when forming the cavity, is then measured out. Without stopping the flow of fluids into the well, a stream of the consolidating gravel pack slurry 26 is pumped down into the cavity 24 from out the bottom of the cap 16*a* and the wash and packing materials supply pipe 17. The gravel pack slurry circulates up and around in the cavity 24 to deposit on the screen 16 forming the consolidated gravel pack 26*a*. The liquid portion of the slurry 26 passes through the screen and up the annulus 23 to exit from pipe 27 at the surface.

Figure 5:
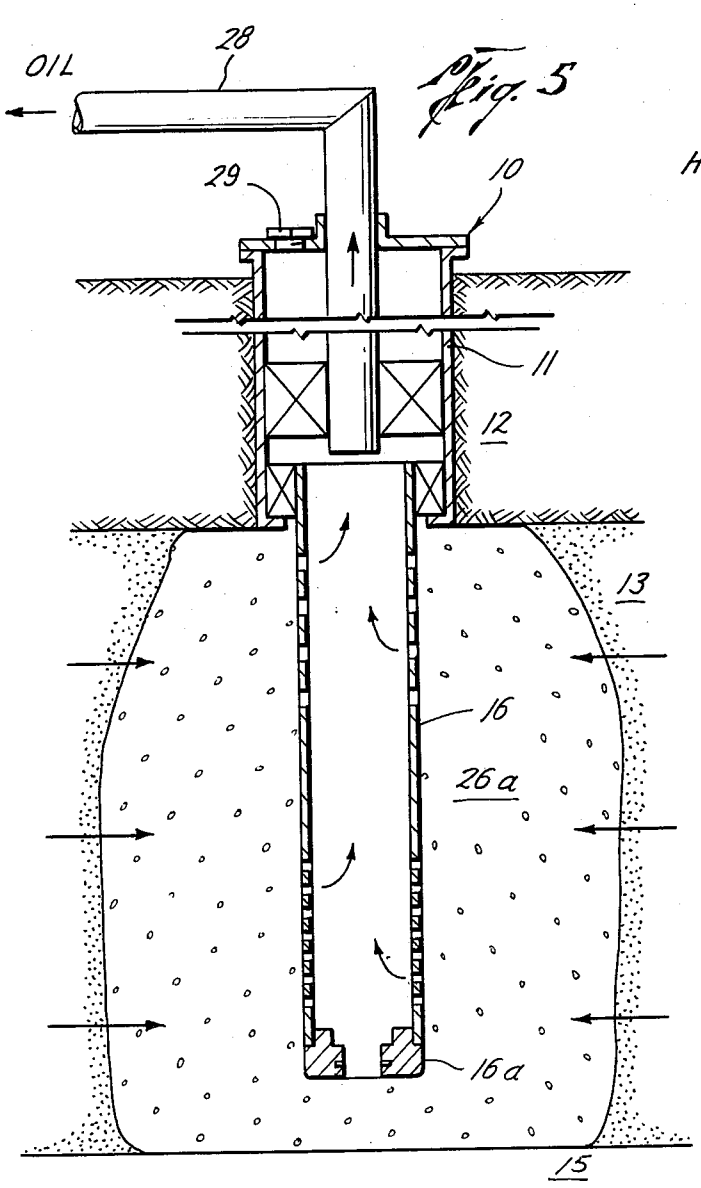
FIG. 5 illustrates the well producing primary crude oil.

The wash pipe 17, FIG. 4, is then removed and replaced with an oil outlet pipe 28, FIG. 5, packed in the casing 11. Exit pipe 27, FIG. 4, is removed and the opening on top of the well sealed with a cap 29, FIG. 5. Primary oil then flows through gravel pack 26*a* and into screen 16 for passage through the oil outlet pipe 28 to the surface for gathering and/or storage.

When the primary oil ceases to flow, secondary recovery is required for continued oil production. Production tubing 30, FIG. 6, is then substituted for the oil outlet pipe 28, FIG. 5, and packed off midway down the screen 16 with packer 30*a* so that oil entering the lower half of the screen may flow, as by being pumped, up through the production tubing 30 to the surface for gathering and/or storage. An injection tube 31 is inserted in the opening formerly closed by cap 29 for injecting secondary recovery fluids, such as hot aqueous fluids including steam, either saturated or superheated, or hot water, etc.

Accordingly, in configuration of FIG. 6, the high pressure hot aqueous fluids are supplied from a suitable source on the surface for passing through injection tube 31 to the well casing 11 and annulus between the screen and production tubing, through the upper perforated portion of the screen above the packer 30*a* through which the hot fluids are ejected into the well cavity 24 for first spreading the gravel pack out and below the level of the packer 30*a*. Then the hot aqueous fluids melt and flow the melted bitumen and tar sands from the tar sand formation through the gravel pack 26*a* toward the screen 16. Only the melted bitumen and wash fluids pass through the gravel pack and screen, to the production tube for passing up through the production string 30 to the collection tank at the surface.

A typical formation with the completed consolidated gravel pack 26*a* is illustrated in FIG. 6 for a 2-inch (5.08 cm) diameter production tube. Here the oil bearing formation is 20 feet (6 meters) thick and the gravel pack 26*a* has a height of 6 feet (1.8 meters) and a radius of 15 feet (4.5 meters). The volume is about 4200 cubic feet (120 cubic meters).

In tar sand formations as unconsolidated oil bearing sands, the conventional gravel pack is required to be consolidated to prevent oil sand flow which results in low oil flow and provides too low oil flow for good commercial production. This invention overcomes this problem by consolidating the gravel pack.

In a modified system the gravel pack in FIG. 6 may be consolidated or congealed with a conventional jell.

Another modified system may utilize a gravel pack consolidated with a thermosetting plastic or resins, such as but not limited to, that disclosed in U.S. Pat. No. 3,297,086.

Accordingly, it will be seen that a method for producing bitumen from tar sands has been described which will operate in a manner which meets each of the objects set forth hereinbefore.

While only a few methods of the invention have been disclosed, it will be evident that various other methods and modifications are possible without departing from the scope of the invention and it is accordingly desired to comprehend within the purview of this invention such methods and modifications as may be considered to fall within the scope of the appended claims.

I claim:

1. A method of sand control in an open hole type of completion extending into a subterranean reservoir to tar sands as unconsolidated petroliferous formation sands comprising the steps of, (a) drilling a well to the top of the petroliferous formation and setting a casing therein, (b) drilling an open hole section of the well to the bottom of the petroliferous formation, (c) setting a screen in the open hole and packing it off against the casing, the screen being large enough to pass a majority of the formation sand and small enough to retain a packing material, (d) running a wash pipe down into the screen for connecting to a nozzle at the bottom of the screen, (e) circulating hot aqueous fluids through the wash pipe and from the lower end thereof for melting the oil or tar for forming a cavity of a predetermined size around the screen and open hole, (f) removing the nozzle from the wash pipe, (g) without stopping the flow of fluids into the well, ejecting a consolidating gravel packing material out the bottom of the wash pipe into the cavity for forming a consolidated gravel pack around the screen, and (h) removing the wash pipe and circulating hot fluids out the screen bottom for secondary recovery production of sand-free oil and melted tar from the petroliferous formation.

2. A method as recited in claim 1 wherein steps (d) and (e) comprise further, (a) forming a lateral fracturable nozzle on the lower end of the screen, and (b) lowering the nozzle, wash pipe, and screen slowly through the depth of the unconsolidated petroliferous formation with the hot aqueous fluids ejecting from the nozzle for forming the cavity of the predetermined size around the screen for melting and producing additional tar and oil from the formation.

3. A method as recited in claim 2 wherein the two steps include further, (a) forming a lateral fracturable nozzle means comprising a plurality of horizontal nozzles radiating from the center of the wash pipe for washing out the cavity for placement of the gravel pack therein.

4. A method as recited in claim 1 wherein step (f) comprises further, (a) pumping a weight down in the wash pipe, and (b) breaking the nozzle from the lower end of the screen with pump pressure for enlarging the lower opening in the screen for the next step of ejecting the consolidating gravel packing material therethrough in a continuous uninterrupted sequence.

5. A method as recited in claim 1 wherein step (g) comprises further, (a) ejecting a jelling gravel packing material from the wash pipe into the cavity for forming a congealed consolidated gravel pack around the screen for maintaining the pack in position.

6. A method as recited in claim 1 wherein step (g) comprises further, (a) ejecting a consolidating plastic packing material from the wash pipe into the cavity for forming a consolidated gravel pack around the screen for increased sand control in completion of wells extending into an unconsolidated petroliferous formation.

7. A method of said control in an open hole type of completion extending into a subterranean reservoir of tar sands as unconsolidated petroliferous formation sands comprising the steps of, (a) drilling a well to the top of the petroliferous formation and setting a casing therein, (b) drilling an open hole section of the well to the bottom of the petroliferous formation, (c) setting a screen in the open hole and packing it off against the casing, the screen being large enough to pass a majority of the formation sand and small enough to retain a packing material, (d) running a wash pipe down into the screen for connecting to a nozzle at the bottom of the screen, (e) circulating hot aqueous fluids through the wash pipe and from the lower end thereof for melting the oil or tar for forming a cavity of a predetermined size around the screen and open hole, (f) removing the nozzle from the wash pipe, (g) packing a tube midway down into the screen, and (h) in a continuous uninterrupted sequence ejecting a consolidating gravel packing material from the upper screen portion above the packer into the cavity to form a consolidated gravel pack around the lower screen portion for improved sand control when producing sand-free crude oil from the unconsolidated petroliferous formation.

8. A method as recited in claim 7 including the following step, (a) circulating hot aqueous fluids from the upper screen portion into the petroliferous formation for primary production of sand-free crude oil through the consolidated gravel pack and into the lower screen portion for recovery at the surface.

9. A method as recited in claim 7 wherein the ejecting step (h) includes, (a) ejecting a jelling packing material from the screen upper portion into the cavity for forming a congealed consolidated gravel pack around the screen lower portion for maintaining the gravel pack in position in the unconsolidated sand formation.

10. A method as recited in claim 7 wherein the ejecting step (h) includes, (a) ejecting a consolidating plastic packing material from the upper screen portion into the cavity for forming a plastic consolidated gravel pack around the lower screen portion for increased sand control in completion of wells extending into the unconsolidated petroliferous formation.

11. A method as recited in claim 7 wherein the step (f) for removing the nozzle comprises, (a) pumping a weight down in the wash pipe, and (b) breaking the nozzle from the lower end of the screen with pump pressure for enlarging the lower opening in the screen for the next step of ejecting the consolidating gravel packing material therethrough in a continuous uninterrupted sequence.

* * * * *